United States Patent [19]

Genini

[11] 4,029,130

[45] June 14, 1977

[54] WEFT YARN GRIPPING ELEMENT FOR LOOMS

[75] Inventor: Graziano Genini, Stabio, Switzerland

[73] Assignee: Albatex A.G., Vaduz, Liechtenstein

[22] Filed: Sept. 23, 1975

[21] Appl. No.: 616,060

[30] Foreign Application Priority Data

Sept. 23, 1974 Switzerland ..... 12833/74

[52] U.S. Cl. ..... 139/196.2

[51] Int. Cl.[2] ..... D03J 5/06

[58] Field of Search ..... 139/122 R, 122 N, 125, 139/126, 196 R, 447, 448, 196.2

[56] References Cited

UNITED STATES PATENTS

| | | | |
|---|---|---|---|
| 2,090,703 | 8/1937 | Rossmann | 139/125 |
| 2,567,993 | 9/1951 | Dewas | 139/448 |
| 3,310,072 | 3/1967 | Strobl | 139/125 |
| 3,543,809 | 12/1970 | Laval | 139/125 |
| 3,719,211 | 3/1973 | Porter | 139/448 |
| 3,741,258 | 6/1973 | Svaty | 139/196.2 |

*Primary Examiner*—Henry S. Jaudon
*Attorney, Agent, or Firm*—Young & Thompson

[57] ABSTRACT

Weft yarn gripping element for gripping and transporting the weft yarn through the shed in continuous weft feed looms, of the type consisting of an elongated flat body of aerodynamic shape comprising yarn gripping means at its extremity, and which is projected in succession with other multiple companion elements into the shed. In this element the yarn gripping means consist of a hooked blade resiliently urged against a lower extension of the elongated flat body, the weft yarn being inserted into the hook of the blade and clamped between said blade and said lower extension of the body.

4 Claims, 3 Drawing Figures

WEFT YARN GRIPPING ELEMENT FOR LOOMS

BACKGROUND OF THE INVENTION

This invention relates to a weft yarn gripping an element for gripping and transporting the weft yarn through the shed in continuous weft feed looms, of the type which is projected from one end of the shed to the other, and recovered from the latter.

Weft yarn gripping and transporting elements are already available in the form of an elongated flattened body of aerodynamic shape, comprising at its end means for gripping the yarn in the form of pincer arms normally in mutual engagement by the action of a spring, and disengageable by the action of a jack which causes them to diverge for feeding or freeing the weft yarn. The weft yarn fed to these elements of known type must be brought exactly into position between the pincer arms at the exact moment in which they open in order to become locked when they re-close, and this evidently requires weft yarn feed devices of considerable precision and corresponding high cost and constructional complication, and leads to a certain uncertainty in the working, since small differences in the operation of the various machine members, or slight deformation of the fed yarn, can easily produce the missing of picks in the loom, because of the weft yarn not being gripped by said members.

Weft yarn gripping and transporting elements are also available in the form of an elongated pincer grip divided at its front into two claws which strike the weft yarn during their travel so that it becomes inserted between the claws and is guided into engagement with elastic gripping means situated on one of the claws.

The gripping and transporting elements of this second type are evidently more reliable in that, while in the case of the former elements any traction force on the transported yarn can prejudice the grip, the yarn being able to escape from the pincer arms which grip it, in the case of the latter elements, the more the yarn is pulled, the more it becomes wedged in the gripping means, and its engagement is in fact of the self-locking type. Changes in the tension of the weft yarn, which are always possible during the travel of the transportation element, can therefore be dangerous in the first case but are perfectly absorbed in the second.

Moreover the gripping and transporting elements of the second type require weft yarn feed devices much simpler than those of the first type, in that they are apt to strike and retain (and then transport) even the weft yarn which is disposed on their path in a relatively approximate manner. However, because of their structure and far wider transverse dimensions, they are not suitable for application to those looms which use a plurality of gripping members projected into the shed in rapid succession. As it has not been possible up to the present time to adapt them to these latter looms, they have found application only in continuous weft feed looms in which the weft transportation elements are caused to make a simple to-and-fro movement, being driven by belts or rods subject to reciprocating motion.

SUMMARY OF THE INVENTION

The present invention relates instead to a type of weft yarn gripping and transporting element which combines the shape and dimension characteristics of the first type examined, with the yarn engagement characteristics of the second type, and thus increases the reliability and considerably simplifies the feed to looms in which multiple projected transportation elements are used.

The weft yarn gripping and transporting element according to the invention, of the type consisting of an elongated flat body of aerodynamic shape comprising yarn gripping means at its extremity, and which is projected in succession with other multiple companion elements into the shed, is characterized in that the said yarn gripping means consist of a hooked blade resiliently urged against a lower extension of the body, the weft yarn being inserted into the hook of the blade and clamped between the blade and the lower extension of the body.

Preferably, the hooked blade is an elongated resilient blade contained for most of its length in a longitudinal cavity in said body, and fixed to the front end of this latter by a screw or the like, its hooked part, projecting at its end, being contained within the overall contour of the body, under normal conditions the elasticity of the blade serving to press its hooked part against the rear extension of the body.

Furthermore, said body comprises a hole in its lower part close to its extremity or to said extension, through which a jack may be inserted when the element is at rest, in order to resiliently raise the hooked blade to release the engagement with the lower extension, so that the weft yarn to be transported may be inserted, or the transported weft yarn freed.

BRIEF DESCRIPTION OF THE DRAWINGS

The invention is described hereinafter in greater detail by way of non-limiting example, with reference to the accompanying drawing which illustrates a preferred embodiment, and in which.

DESCRIPTION OF THE PREFERRED EMBODIMENT

Figure 1:
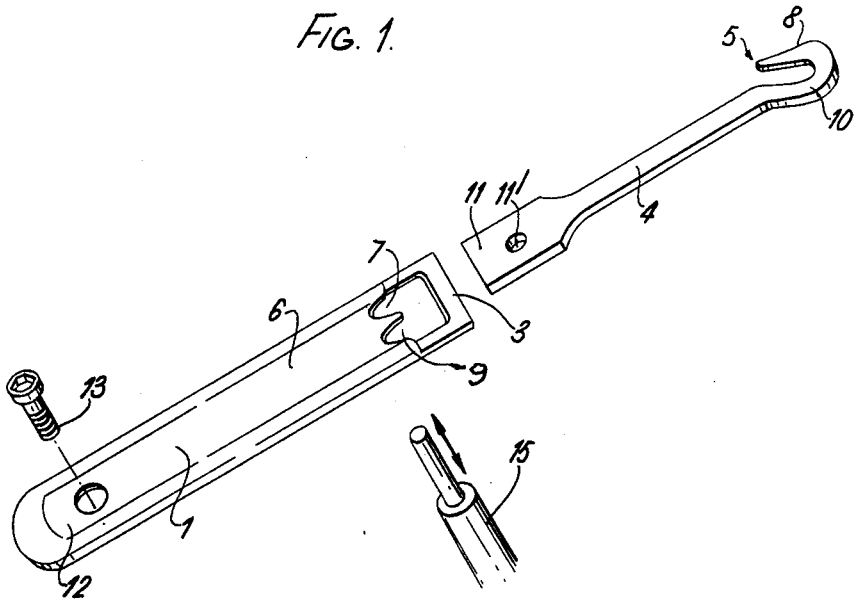
FIG. 1 is a view of the weft yarn gripping and transporting element according to the invention with its parts separated, and of the jack for its operation.

As can be seen from the figures, the weft yarn gripping and transporting element according to the invention comprises an elongated flattened body 1 of strongly aerodynamic shape, provided with an inner longitudinal cavity 2 and a rear extension 3. The cavity 2 of the body 1 houses the greater part of the length of a resilient blade 4 which terminates in a hooked part 5 disposed externally, on the extension 3 of the body 1.

Figure 2:
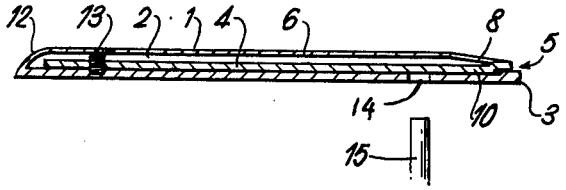
FIG. 2 is a longitudinal section through the same element in the normal position of gripping and transporting.

The upper rear part 6 of the body 1 is shaped in the form of the hook 5 to provide on one side a cavity 7 for the end 8 of the hook, and on the other side a cavity 9 for the part 10 which connects the hook to the body of the blade 4. The blade 4 is fixed at its smooth end 11 by way of the hole 11' to the front end 12 of the body 1 by any suitable means, for example by one or more screws or rivets 13. Under normal conditions it is disposed as shown in FIG. 2, with the hooked part 5 pressed forcibly by the resilience of the blade 4 against the extension 3 of the body 1. In this position, the hook 8, 10 is completely contained in the overall contour of the body 1 and for this reason, together with the particular configuration of the cavities 7 and 9, it is unable to engage any yarn which may intersect its path of travel and is consequently unable to grip it in order to retain it. Neither is it possible to insert the weft yarn. The element according to the invention presents a perfectly smooth surface under these conditions, which is most advantageous for its use.

Figure 3:
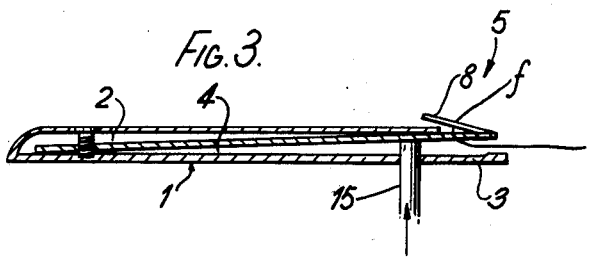
FIG. 3 is a section similar to that of FIG. 2 through the member in the position in which its engagement with the yarn has been released.

For the purpose of weft insertion, which is done with the element at rest, the lower part of the element comprises a hole 14 into which can be inserted a jack 15 to resiliently raise the hooked end 5 of the blade 4 so that it becomes disposed in the position of FIG. 3, in which the hook 8 projects from the contour of the body 1. In this manner the weft yarn *f* may be inserted with extreme ease and becomes securely gripped, once it is clamped (on re-lowering the jack 15) between the hooked part 5 of the blade 4 and the extension 3 of the body 1. The weft yarn may be freed from the gripping element by a jack similar to the jack 15, but situated on the opposite side of the loom.

There are no rigorous limitations on the materials which may be used to construct a gripping and transporting element according to the invention. However, because of the particular structure used and the operation of the various cooperating parts of the element, it is generally preferable to use steel and more especially stainless steel for the body 1, and normal or special steels for the hooked blade 4 of the element.

The advantages of this gripping and transporting element with respect to conventional elements of the same type are considerable. Firstly, the gripping and transporting element according to the invention preserves the characteristics of compactness, simplicity and ease of control of conventional elements, and, as in the case of these latter, may be inserted into the shed with properly contoured smooth surfaces which prevent any possible interference with the warp yarns and cause any stresses on the warp yarns to be very small. Moreover, the gripping element according to the invention permits reliable insertion of the weft yarn at the moment of feed, without requiring special accuracy of positioning of the yarn itself, and guarantees a perfect and reliable gripping of the yarn during transportation because of the positive action of the hooked element, between which and the body of the gripping element the yarn is retained. This grip may be obtained using much smaller resilient forces than those used for the pincer grip device of known gripping elements, and without the need for knurling or toothing of the parts in contact with the yarn to be gripped. These means are in fact advisable in conventional systems where any supplementary traction in the work could remove the grip, but they would have no advantage in the case of the element according to the invention, where an increase in traction on the yarn only increases the grip by the hooked element, provided there is a sufficient coupling force between this latter part and the body of the gripping element.

Furthermore, the gripping and transporting element according to the invention is equally suitable for operating with thin or thick wefts without requiring any modification or adjustment. A single type of gripping element according to the invention may therefore be produced for use with any type of weft, with obvious advantage.

The embodiments of the invention may be other than that described, and modifications may be made to it within the scope of the inventive idea.

I claim:

1. Weft yarn gripping and transporting element comprising an elongated flat body of aerodynamic shape comprising yarn gripping means at its extremity, said yarn gripping means comprising a hooked blade resiliently urged against a lower extension of the body, said body having upper and lower parts disposed above and below said blade, respectively, said upper part at its end adjacent the hook of the blade having a recess for reception of said hook, said blade having a part by which it is connected to said hook, said upper part of said body having therein a further recess for the reception of said connecting part.

2. Gripping and transporting element as in claim 1, wherein said hooked blade is an elongated resilient blade contained for most of its length in a longitudinal cavity in said body, to one end of which it is fixed its hooked part, projecting at its other end, being contained within the overall contour of the body, the elasticity of the blade serving to press its hooked part against the lower extension of the body.

3. Gripping and transporting element as in claim 2, wherein said body comprises a hole in said lower extension, adjacent to hook of the blade.

4. Gripping and transporting element as in claim 3 constructed of steel.

* * * * *